US007887426B2

(12) United States Patent
Hlynka

(10) Patent No.: US 7,887,426 B2
(45) Date of Patent: Feb. 15, 2011

(54) WATERSLIDE BOWL STRUCTURE AND METHOD OF CONSTRUCTION

(75) Inventor: Marvin R. Hlynka, Richmond (CA)

(73) Assignee: Whitewater West Industries Ltd., Richmond, BC (CA)

( * ) Notice: Subject to any disclaimer, the term of this patent is extended or adjusted under 35 U.S.C. 154(b) by 440 days.

(21) Appl. No.: 12/038,896

(22) Filed: Feb. 28, 2008

(65) Prior Publication Data

US 2009/0221377 A1 Sep. 3, 2009

(51) Int. Cl.
*A63G 21/18* (2006.01)
*A63G 21/00* (2006.01)

(52) U.S. Cl. ..... 472/117; 104/70

(58) Field of Classification Search ..... 472/13, 472/116, 117, 128, 129; 104/69, 70, 53
See application file for complete search history.

(56) References Cited

U.S. PATENT DOCUMENTS 4,196,900 A * 4/1980 Becker et al. ..... 472/117
4,198,043 A 4/1980 Timbes et al.
4,429,867 A * 2/1984 Barber ..... 472/13
5,433,671 A * 7/1995 Davis ..... 472/117
6,450,891 B1 9/2002 Dubeta
6,485,372 B2 11/2002 Stuart et al.
6,527,646 B1 * 3/2003 Briggs ..... 472/117
D521,098 S 5/2006 Hunter
7,056,220 B2 6/2006 Hunter
D548,810 S 8/2007 Hunter
D583,895 S 12/2008 Hlynka
2009/0062025 A1 3/2009 Hlynka

FOREIGN PATENT DOCUMENTS

AU 524315 11/1980
GB 2 224 948 A 5/1990

* cited by examiner

*Primary Examiner*—Kien T Nguyen
(74) *Attorney, Agent, or Firm*—Snell & Wilmer L.L.P.

(57) ABSTRACT

A waterslide bowl has a fixed rider path from entrance to exit. The bowl comprises a trough which is made of a plurality of sets of trough sections, attached together, in which the trough sections of a given set are the same, permitting the rider surface of the bowl to be made from trough sections having a small number of different shapes. This reduces the number of molds that would otherwise be required to make the trough sections. The waterslide bowl may also have two or more separate troughs, nested together.

18 Claims, 6 Drawing Sheets

WATERSLIDE BOWL STRUCTURE AND METHOD OF CONSTRUCTION

TECHNICAL FIELD OF THE INVENTION

The invention pertains to waterslides, and, in particular, to a waterslide bowl having a trough to guide a rider in a fixed path from the entrance of the bowl to its exit.

BACKGROUND OF THE INVENTION

In the art of waterslide design, it is known to include a bowl as one element of a waterslide apparatus. Such bowls are typically configured so that the rider enters the bowl through a flume on a tangential trajectory and slides around the bowl in a generally spiral path before exiting through an opening at the bottom of the bowl. Examples of such waterslide bowls are disclosed in Stuart et al., U.S. Pat. No. 6,485,372 and GB 2,224,948.

In conventional waterslide bowls, riders do not follow a fixed path in the bowl because there is no guiding structure on the rider surface of the bowl. The causes inconsistent performance: a rider may go around the bowl once, twice or more times. Since the rider capacity of a waterslide is limited by the maximum length of time it takes a rider to traverse the waterslide, variability in the length of time that riders spend traversing the bowl reduces the capacity of the waterslide. A fixed path in the bowl would make the rider's experience of the ride, and the duration of the ride, more uniform.

One possible approach to this problem is to mold a continuous trough in the bottom of the bowl to guide the rider from the bowl entrance to its exit in a fixed, approximately spiral path. However, since waterslide bowls are conventionally made by attaching together molded pie-shaped segments, a large number of individually-shaped segments would be required to create such trough by such molding method.

Another possible approach is to have elements in the bowl that form a partial trough which captures the riders and guides them to the exit. However, that may introduce a hazard in the form of a fin or edge that divides adjacent parts of the trough.

SUMMARY OF THE INVENTION

The invention provides a waterslide bowl that has a fixed rider path from entrance to exit. The bowl comprises a trough which is made of a plurality of sets of trough sections, attached together, in which the trough sections of a given set are the same, permitting the rider surface of the bowl to be made from trough sections having a relatively small number of different shapes. This reduces the number of molds that would otherwise be required to make the trough sections and accordingly reduces fabrication costs. The waterslide bowl may comprise a single trough, or it may comprise two or more troughs which nest together.

According to one embodiment of the invention, in which the bowl has a single trough, there is provided a waterslide bowl comprising a rider entrance, a rider exit and a trough to guide the rider in a fixed path from the entrance to the exit. The trough has a width W and comprises a plurality of sets of trough sections, each set comprising one or more of the trough sections. Each set forms one half of a circle and has a respective radius. The sets comprise an inner set adjacent to the rider exit, an outer set, and one or more intermediate sets between the inner and outer sets. The radius of each set that is outward from the inner set is larger than the radius of a respectively adjacent inward set by a distance of W/2.

According to another embodiment of the invention, in which the bowl has single trough, there is provided a waterslide bowl comprising a rider entrance, a rider exit and a trough to guide a rider in a fixed path from the entrance to the exit. The trough has a width W and comprises a plurality of sets of trough sections. Each set forms one half of a circle and has a respective radius. A first set of trough sections is adjacent to the rider exit and has a radius A. A second set of trough sections is contiguous with the first set and has a radius B approximately equal to A plus W/2. A third set of trough sections is contiguous with the second set and has a radius C approximately equal to B plus W/2.

According to a further embodiment of the invention, there is provided a waterslide bowl comprising a rider entrance, a rider exit and a trough to guide a rider in a fixed path from the entrance to the exit. The trough comprises a plurality of sets of trough sections, each set forming one half of a circle and having a respective radius. The sets comprise an inner set adjacent to the rider exit, an outer set adjacent to the rider entrance and one or more intermediate sets between the inner and outer sets. The radius of the one-half circle formed by each respective set that is outward from the inner set is larger than the radius of an adjacent inward set such that the fixed path is a continuous curved path.

According to a further embodiment of the invention, there is provided a waterslide bowl having two troughs which nest together in a side-by-side arrangement, each trough having its own rider entrance and exit, whereby two riders can use the bowl at the same time, each in a separate trough. The first trough comprises a plurality of sets of trough sections, each set forming one-half of a circle and having a respective radius, the plurality of sets comprising an inner set adjacent to the first rider exit, an outer set adjacent to the first rider entrance and one or more intermediate sets, the radius of each respective set that is outward from the inner set being larger than the radius of an adjacent inward set such that the fixed path is a continuous curved path. The radius of each set that is outward from the inner set may be larger than the radius of a respectively adjacent inward set by a distance of about W. The second trough has essentially the same configuration, such that the two troughs fit together to form a rider surface of the bowl.

The invention also provides a method of making a waterslide bowl having a single trough to guide a rider in a fixed path from a rider entrance to a rider exit. A first set of trough sections is provided, the sections having a width W, the first set forming one half of a circle having a first radius. A second set of trough sections is provided, the sections of the second set having the same width W, the second set forming one half of a circle having a second radius. The second radius is larger than the first radius by a distance equal to or greater than W/2. The two sets are assembled to form the trough.

These and other features of the invention will be apparent from the following description and drawings of the preferred embodiments.

DESCRIPTION OF THE PREFERRED EMBODIMENTS

Figure 1:
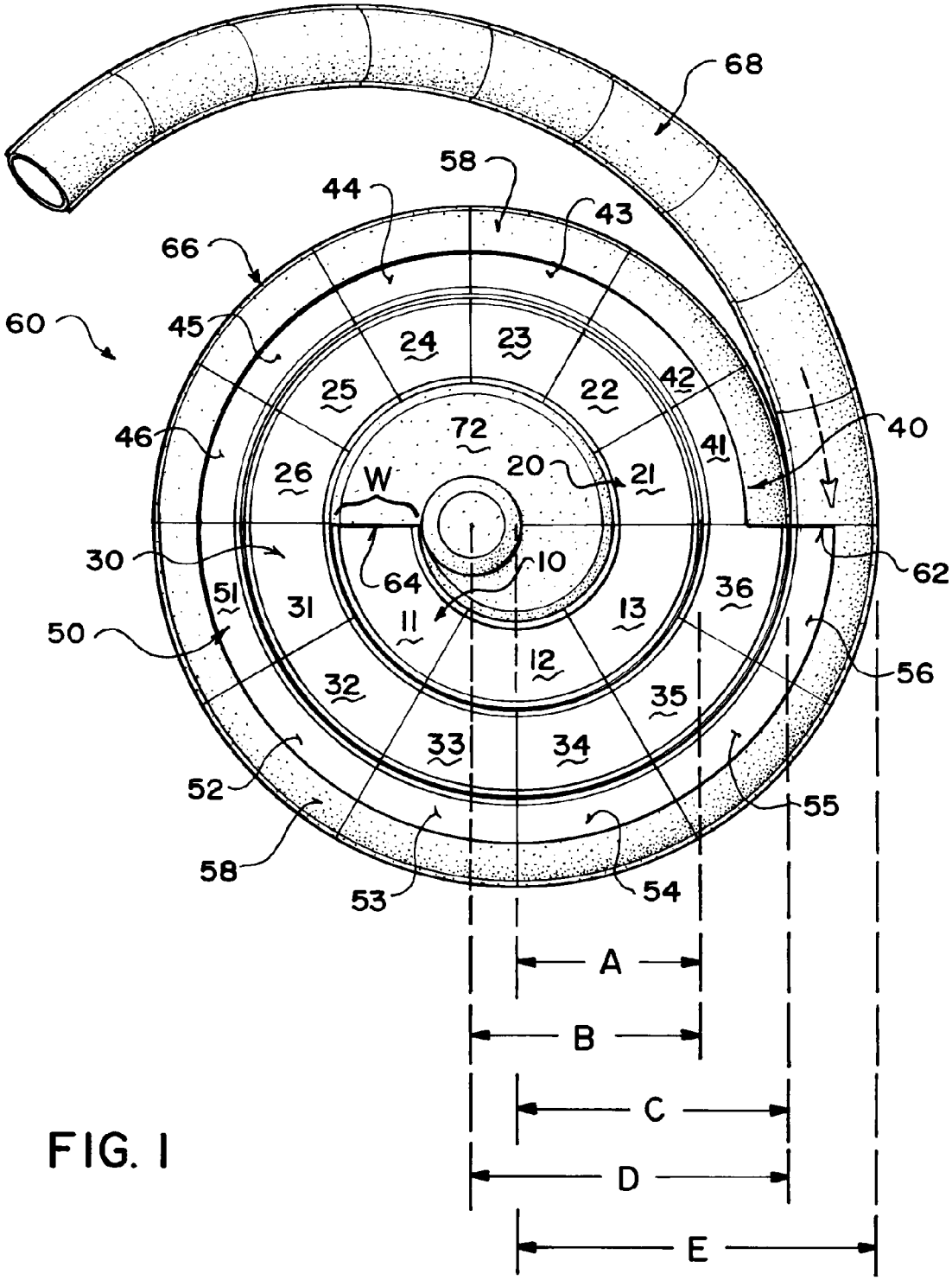
FIG. 1 is a top plan view of one embodiment of the waterslide bowl.
Figure 2:
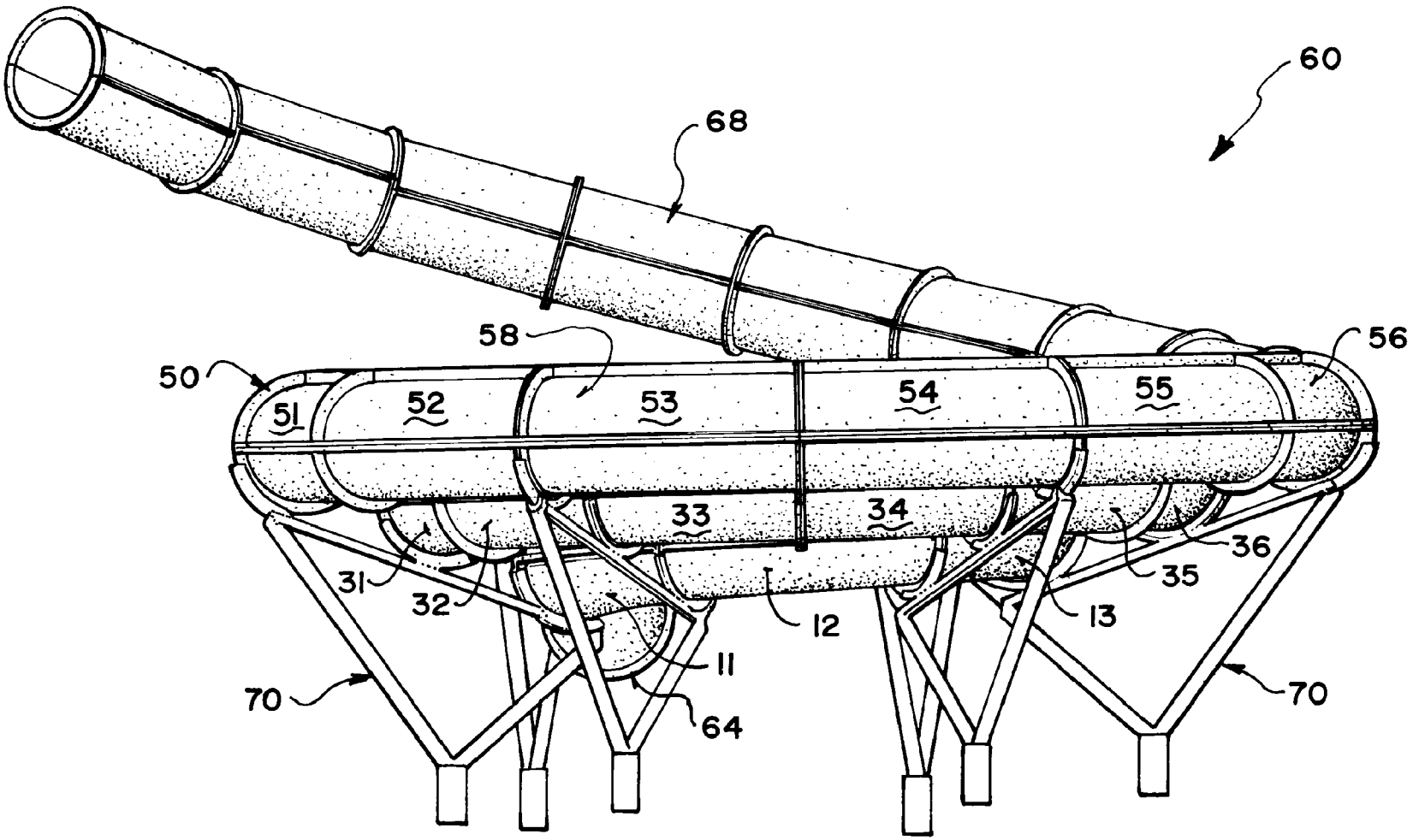
FIG. 2 is a side elevation view thereof.

In the following description and drawings, corresponding and like parts are referred to by the same reference characters.

Referring first to FIGS. 1 to 4, the waterslide bowl 60 has a rider entrance 62, a rider exit 64 and a trough 66 extending in a continuous, curved path between the entrance and the exit. The trough 66 forms the rider surface of the bowl. The bowl 60 is roughly circular with the entrance 66 being at its outer edge and the exit 64 being near the center and at a lower elevation than the entrance. The path described by the trough 66 is accordingly a fixed, continuously curving path that is roughly spiral, and descends from a relatively higher elevation at the entrance 62 to a relatively lower elevation at the exit 64. The bowl 60 is supported on a floor by the bowl supports 70.

The bowl 60 is one component of a waterslide apparatus. A flume 68 leading from an upstream part of the waterslide apparatus (not shown in the drawings) is affixed to the bowl 60 at the rider entrance 62. A rider descends through the flume 68 and enters the bowl 60 through the rider entrance 62. After traversing the bowl, the rider exits the bowl through the exit 64, which leads by a flume or slide to downstream elements of the waterslide apparatus or to a pool, mat, or other soft landing element which terminates the ride. The waterslide bowl can be used by a rider with or without a ride-on device such as a mat or tube.

The trough 66 is made of a plurality of sets of individual trough sections. In the illustrated embodiment, there are five such sets, designated as 10, 20, 30, 40 and 50. The first set is the innermost set in the bowl, being adjacent to and leading into the rider exit 64. It comprises three trough sections 11, 12 and 13. Each trough section is an individual component, the sections being affixed together to form a set. The set 10 of trough sections 11, 12 and 13 forms a half-circle which has a radius designated A in the drawings.

The second set 20 of trough sections continues the trough 66 outwardly in the bowl from the first set 10, and comprises six trough sections 21, 22, 23, 24, 25 and 26. This set 20 forms a half-circle which has a radius designated B in the drawings. All of the trough sections of the bowl have the same width, designated W in the drawings. The radius B is longer than the radius A by a distance of W/2. It will be apparent that the diameter of the half-circle formed by the second set 20 of trough sections is greater than the diameter of the half-circle formed by the first set 10 of trough sections by a distance equal to W. The first set 10 and the second set 20 of trough sections fit around and nest against the center member 72 of the bowl.

The third set 30 of trough sections continues the trough 66 outwardly in the bowl 60 from the second set 20, and comprises six trough 30 sections 31, 32, 33, 34, 35 and 36. This set 30 of trough sections forms a half-circle which has a radius designated C in the drawings. The radius C is longer than the radius B by a distance of W/2. The diameter of the half circle formed by the third set 30 of trough sections is therefore greater than the diameter of the half-circle formed by the second set 20 of trough sections by a distance equal to W. The third set 30 of accordingly fits around and nests against the first set 10 of trough sections.

The fourth set 40 of trough sections continues the trough 66 outwardly in the bowl 60 from the third set 30, and comprises six trough sections 41, 42, 43, 44, 45 and 46. The set 40 of trough sections forms a half-circle which has a radius designated D in the drawings. The radius D is longer than the radius C by a distance of W/2. The diameter of the half circle formed by the fourth set 40 of trough sections is therefore greater than the diameter of the half-circle formed by the third set 30 of trough sections by a distance equal to W. The fourth set 40 accordingly fits around and nests against the second set 20 of trough sections.

Figure 3:
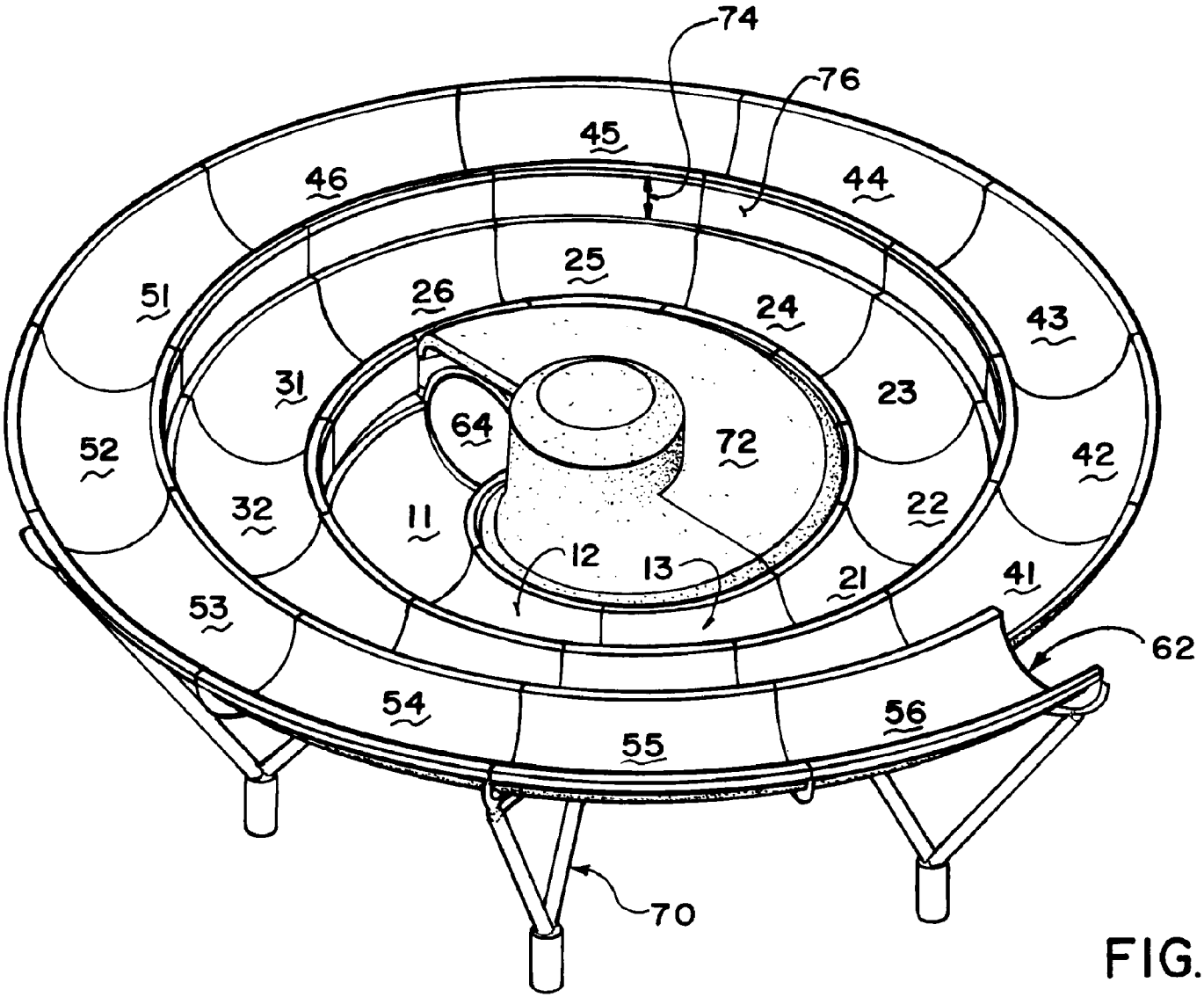
FIG. 3 is a perspective view thereof, without the flume.
Figure 4:
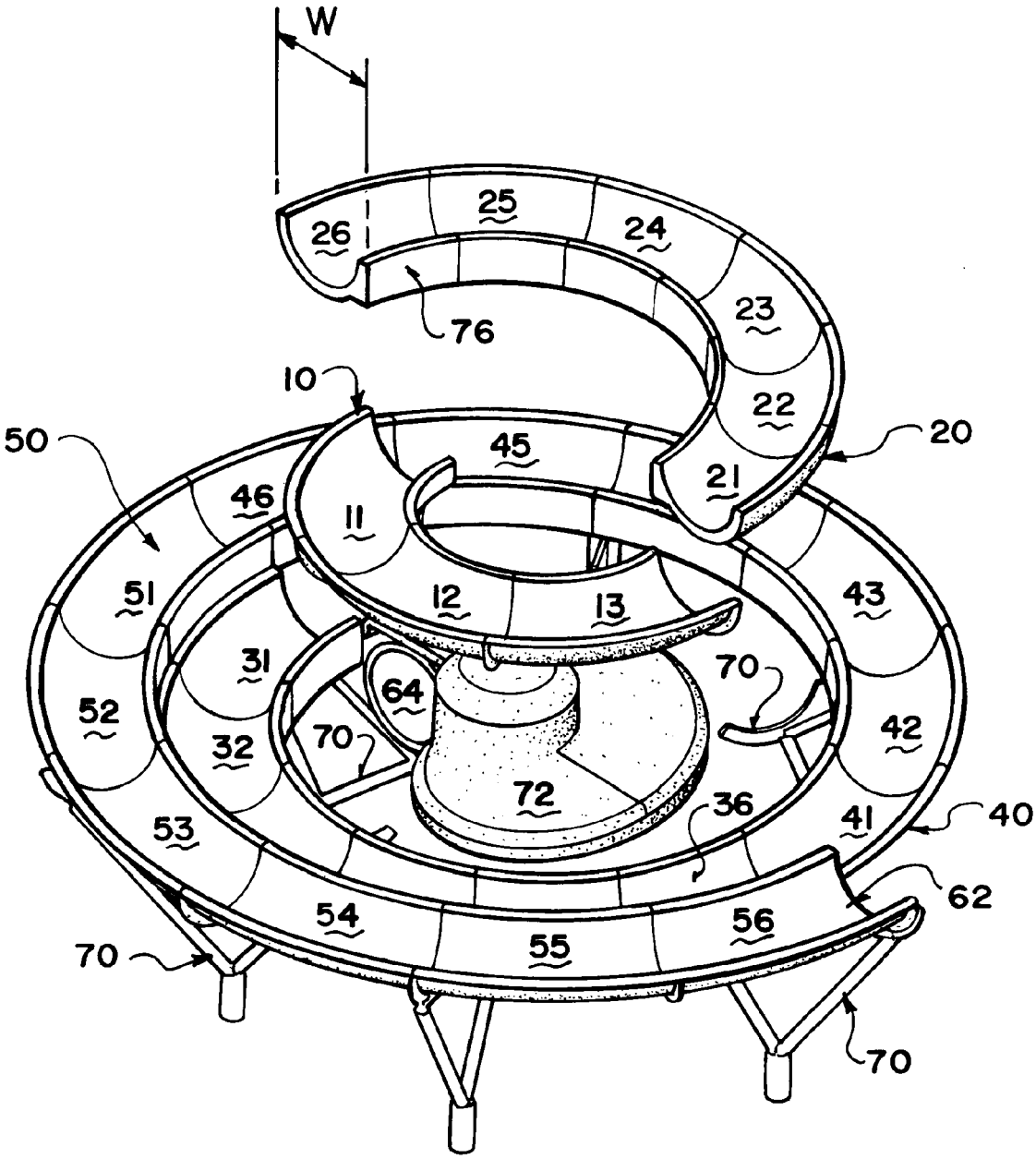
FIG. 4 is a perspective view thereof, without the flume, showing the bowl partially disassembled, with two sets of trough sections separated from the bowl.

As best seen in FIG. 3, due to the vertical descent of the trough going from the entrance to the exit, a vertical gap 74 is formed between the edges of radially-adjacent trough sections. This gap 74 corresponds to the height of the inner wall 76 of the trough sections (best seen in FIG. 4). The gap may optionally be covered by suitable detail pieces (not shown) so that the inner surface of the bowl is unbroken and smooth.

The fifth set 50 of trough sections continues the trough 66 outwardly in the bowl 60 from the fourth set 40 to the rider entrance 62, and comprises six trough sections 51, 52, 53, 54, 55 and 56. This set 50 of trough sections forms a half-circle which has a radius designated E in the drawings. The radius E is longer than the radius D by a distance of W/2. The diameter of the half-circle formed by the fifth set 50 of trough sections is therefore greater than the diameter of the half-circle formed by the fourth set 40 of the trough sections by a distance equal to W. The fifth section accordingly fits around and nests against the third set 30 of trough sections.

The trough sections of a given set are substantially identical to each other in shape and size. For example, each of trough sections 11, 12 and 13 are the same as each other; and each of trough sections 21, 22, 23, 24, 25 and 26 are the same as each other; and so on for the other sets. As a result, the riding surface of the trough 66 can be made from only five different shapes of trough sections. The trough sections are made of molded plastics material, so only five different molds are required to form the trough sections.

An upwardly-extending sidewall 58 is provided on the outer side of sets 40 and 50 of the trough sections to retain the rider in the trough after entering the bowl. For clarity of illustration, the sidewall is not shown in FIGS. 3 and 4.

It will be apparent that the waterslide bowl can be made larger or smaller than the illustrated bowl 60, providing more or fewer revolutions about the bowl for a rider, by having more or fewer sets of trough sections. For example, the bowl could be made smaller, providing a path one revolution less around the bowl, by omitting the outer sets 40 and 50 and affixing the flume 68 to trough section 36. Similarly, the bowl could be made larger, providing a path, for example, one-half revolution longer around the bowl, by adding an additional set of trough sections to continue the path outward from trough section 56, the additional set forming a half half-circle with a radius longer than the radius E of the half-circle formed by the set 50 by a distance equal to W/2.

It will be apparent that the modular construction of the bowl also permits the rider entrance and the rider exit of the bowl to be located at any selected radial position. For example, referring to the FIG. 1 orientation, the rider entrance could be located at the six o'clock position rather than the three o'clock position by omitting the outer three trough sections 54, 55 and 56, and attaching the flume 68 to trough section 53.

Figure 5:
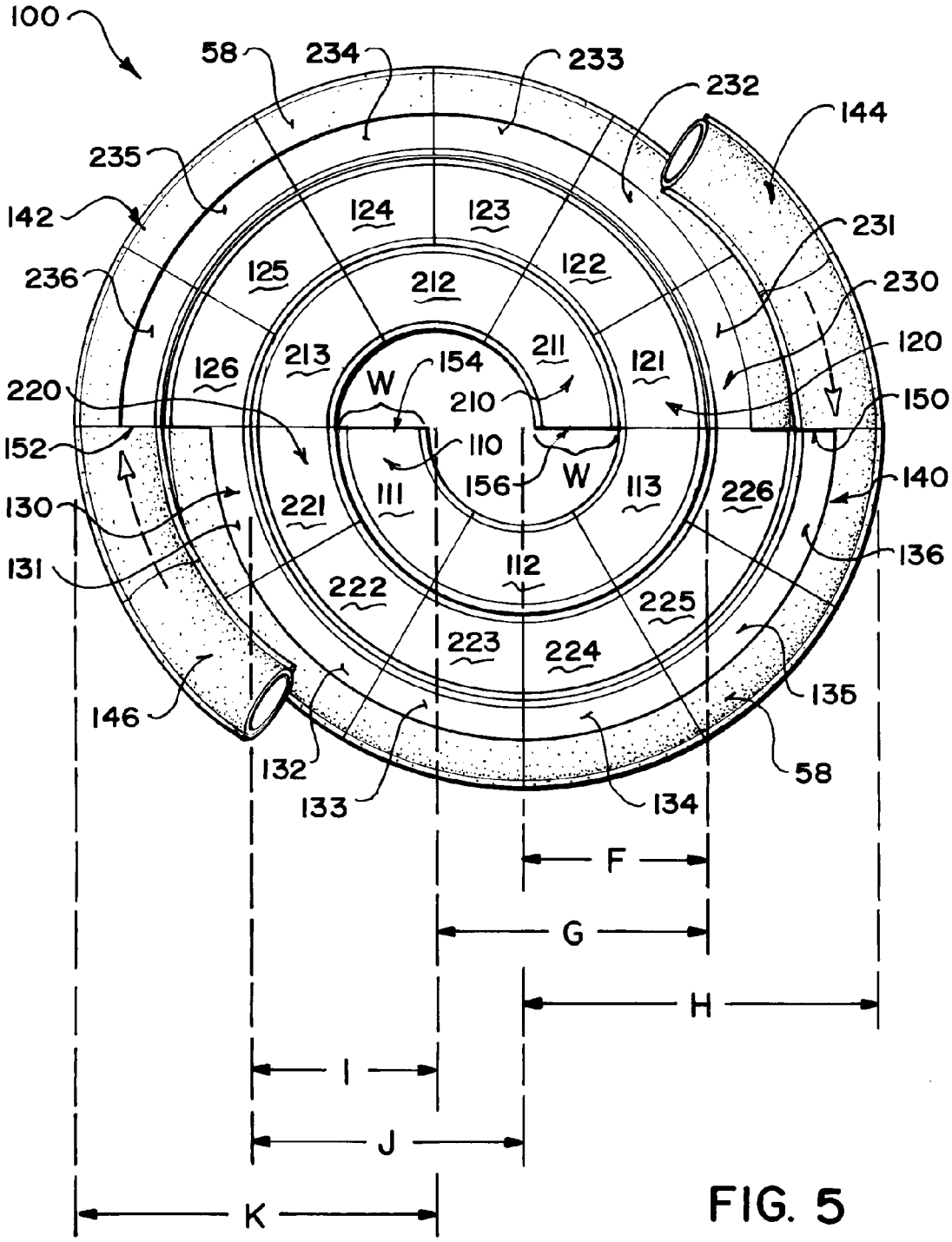
FIG. 5 is a top plan view of a second embodiment of the waterslide bowl, having two troughs.
Figure 6:
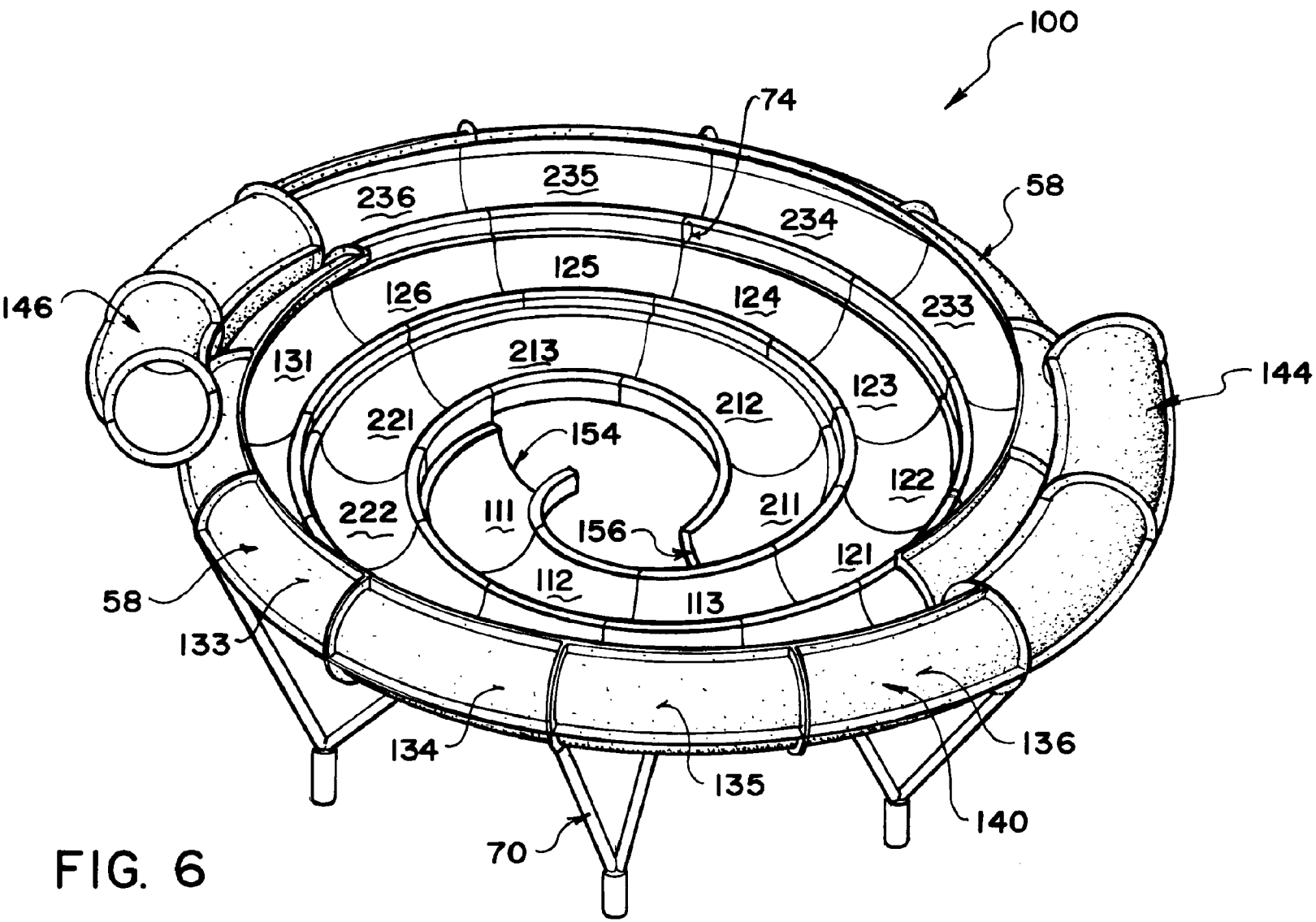
FIG. 6 is a perspective view of the waterslide bowl of FIG. 5.

In a further embodiment of the invention, shown in FIGS. 5 and 6, a waterslide bowl 100 comprises two nesting troughs. The waterslide bowl 100 has two rider entrances 150, 152 and two rider exits 154, 156. A first trough 140 extends in a continuous, curved path between one entrance 150 and one exit 154, and a second trough 142 extends between the other entrance 152 and other exit 156, the two troughs 140, 142 nesting together, as described below, and forming the rider surface of the bowl 100. The paths defined by the two troughs descend from a relatively higher elevation at the entrances 150, 152 to a relatively lower elevation at the exits 154, 156. The bowl 100 is supported on a floor by bowl supports 70. A flume 144 is affixed to the bowl at one rider entrance 150 and a second flume 146 is affixed to the bowl at the other rider entrance 152.

The first trough 140 is made of three sets 110, 120, 130 of individual trough sections. The first set 110 is the innermost set, being adjacent to and leading into the first rider exit 154. It comprises three trough sections 111, 112 and 113. Each trough section is an individual component, the sections being affixed together to form a set. All of the trough sections of the bowl 100 have the same width, designated W in the drawings. The set 110 of trough sections 111, 112 and 113 forms a half-circle which has a radius designated F in the drawings.

The second set 120 of trough sections continues the first trough outwardly in the bowl from the first set 110, and comprises six trough sections 121, 122, 123, 124, 125 and 126. This set 120 forms a half-circle which has a radius designated G in the drawings. The radius G is longer than the radius F by a distance of W.

The third set 130 of trough sections continues the trough 140 outwardly in the bowl 100 from the second set 120, and comprises six trough sections 131, 132, 133, 134, 135 and 136. This set 130 forms a half-circle which has a radius designated H in the drawings. The radius H is longer than the radius G by a distance of W.

It will be apparent that the configuration of the first trough 140, by reason of the relationship between the respective radii of the three sets 110, 120 and 130, forms a space in which the second trough 142, identical in configuration to the first trough 140, can interfit in a nesting, side-by-side arrangement, with the first trough.

The second trough 142 comprises three sets 210, 220, 230 of individual trough sections. The first set 210 is the innermost, being adjacent to and leading into the second rider exit 156. It comprises three trough sections 211, 212 and 213. This set 210 forms a half-circle which has a radius I, this radius I being the same as the radius F of the half-circle formed by the trough set 110.

The second set 220 of trough sections of the second trough 142 continues the trough outwardly in the bowl from the first set 210 and comprises six trough sections 221, 222, 223, 224, 225 and 226. This set 220 forms a half-circle which has a radius J, this radius J being the same as the radius G of the half-circle formed by the trough set 120. Accordingly, the radius J is longer than the radius I by a distance of W.

The third set 230 of trough sections continues the second trough 142 outwardly in the bowl 100 from the second set 220 and comprises six trough sections 231, 232, 233, 234, 235 and 236. This set 230 of trough sections forms a half-circle which has a radius K, this radius K being the same as the radius H of the half-circle formed by the set 130 of trough sections. Accordingly, the radius K is longer than the radius J by a distance of W.

The trough sections of a given set are substantially identical to each other in size and shape. Thus, each of the trough sections 111, 112 and 113 are the same as each other, and also the same as each of the trough sections 211, 212 and 213; and so on for the other sets. As a result, the riding surface of the two troughs can be made from only three different shapes of trough sections.

The bowl 100 can be ridden in by two riders at the same time, each rider being in his or her own trough 140 or 142.

As with the first embodiment of the waterslide bowl 60, the second embodiment of the bowl 100 can be made larger or smaller than the illustrated bowl, and the rider entrances and exits can be located at any selected radial positions.

The invention is not limited to waterslide bowls having a single trough (as exemplified by bowl 60) or having two nesting troughs (as exemplified by bowl 100), but includes bowls having three or more nesting 30 troughs. Three troughs will fit together in a nesting configuration to form a bowl, similar to bowl 100, where the incremental increase in the size of the radii of adjoining sets of trough sections is 3/2 W (rather than W, for two troughs, as in bowl 100; or W/2 for one trough, as in bowl 60). Similarly, four troughs will fit together in a nesting configuration where the incremental increase is 2 W; five troughs will fit together in a nesting configuration where the incremental increase is 5/2 W, and so on.

EXAMPLE

A waterslide bowl made in accordance with the embodiment of FIGS. 1-4 comprises five sets of trough sections. The outer diameter of the outer set is 13.695 m. The vertical drop from the rider entrance to exit is 1.592 m. The width of the trough is 1.676 m. The radii of the half-circles formed by the five sets of trough sections, from inner to outer, are respectively 2.662 m, 3.500 m, 4.338 m, 5.175 m and 6.013 m.

Although the invention has been described in terms of specific embodiments, it is not intended that the invention be limited to these embodiments. Various modifications within the scope of the invention will be apparent to those skilled in the art. For example, the radius of the half-circle formed by each successively outward set of trough sections can be larger than the radius of a respectively adjacent inward set by a distance that is greater than W/2; however, that results in spaces between radially-adjacent sets of trough sections rather than the snug nesting that results when the distance is W/2, which is the preferred configuration. The scope of the invention is defined by the claims that follow.

What is claimed is:

1. A waterslide bowl comprising:

a rider entrance, a rider exit and a trough to guide a rider in a fixed path from said entrance to said exit, said trough having a width W, said trough comprising a plurality of sets of trough sections, each said set comprising one or more of said trough sections, each said set forming one half of a circle and having a respective radius, said plurality of sets comprising an inner set adjacent to said rider exit, an outer set, and one or more intermediate sets between said inner and outer sets, said radius of each said set that is outward from said inner set being larger than said radius of a respectively adjacent inward set by a distance of about W/2.

2. A waterslide bowl according to claim 1, wherein said trough sections that comprise a respective set of trough sections are substantially the same as each other.

3. A waterslide bowl comprising a rider entrance, a rider exit and a trough to guide a rider in a fixed path from said entrance to said exit, said trough having a width W, said trough comprising a plurality of sets of trough sections, each said set forming one half of a circle and having a respective radius, said plurality of sets comprising:

(i) a first set adjacent to said rider exit and having a radius A;

(ii) a second set contiguous with said first set and having a radius B approximately equal to A plus W/2; and (iii) a third set contiguous with said second set and having a radius C approximately equal to B plus W/2.

4. A waterslide bowl according to claim 3, wherein said plurality of sets further comprises a fourth set contiguous with said third set and having a radius D approximately equal to C plus W/2.

5. A waterslide bowl according to claim 4, wherein said plurality of sets further comprises a fifth set contiguous with said fourth set and having a radius E approximately equal to D plus W/2.

6. A waterslide bowl comprising:

a rider entrance, a rider exit and a trough to guide a rider in a fixed path from said entrance to said exit, said trough comprising a plurality of sets of trough sections, each said set forming one half of a circle and having a respective radius, said plurality of sets comprising an inner set adjacent to said rider exit, an outer set adjacent to said rider entrance and one or more intermediate sets between said inner and outer sets, said radius of each respective set that is outward from said inner set being larger than said radius of an adjacent inward set such that said fixed path is a continuous curved path.

7. A waterslide bowl according to claim 6, wherein said curved path is approximately spiral.

8. A waterslide bowl according to claim 6, wherein said bowl further comprises a second rider entrance, a second rider exit and a second trough to guide a second rider in a second fixed path from said second entrance to said second exit, said second trough comprising a plurality of sets of trough sections, each said set forming one half of a circle and having a respective radius, said plurality of sets comprising an inner set adjacent to said second rider exit, an outer set adjacent to said second rider entrance and one or more intermediate sets between said inner and outer sets, said radius of each respective set that is outward from said inner set being larger than said radius of an adjacent inward set such that said second fixed path is a continuous curved path.

9. A waterslide bowl according to claim 8, wherein said troughs have a width W and said radius of each said respective set that is outward from said inner set is larger than said radius of an adjacent inward set, by a distance of about W, in both said troughs.

10. A waterslide bowl according to claim 8, wherein said two troughs are in a nesting side-by-side arrangement.

11. A waterslide bowl comprising:

a first rider entrance, a first rider exit and a first trough to guide a first rider in a fixed path from said first entrance to said first exit, a second rider entrance, a second rider exit and a second trough to guide a second rider in a fixed path from said second entrance to said second exit, said first trough having a width W, said first trough comprising a plurality of sets of trough sections, each said set comprising one or more of said trough sections, each said set forming one half of a circle and having a respective radius, said plurality of sets comprising an inner set adjacent to said first rider exit, an outer set, and one or more intermediate sets between said inner and outer sets, said radius of each said set that is outward from said inner set being larger than said radius of a respectively adjacent inward set by a distance of about W, said second trough having a width W, said second trough comprising a plurality of sets of trough sections, each said set comprising one or more of said trough sections, each said set forming one half of a circle and having a respective radius, said plurality of sets comprising an inner set adjacent to said second rider exit, an outer set, and one or more intermediate sets between said inner and outer sets, said radius of each said set that is outward from said inner set being larger than said radius of a respectively adjacent inward set by a distance of about W.

12. A waterslide bowl according to claim 11, wherein said first and said second troughs are in a nesting, side-by-side arrangement.

13. A waterslide bowl comprising:

a first rider entrance, a first rider exit and a first trough to guide a first rider in a fixed path from said first entrance to said first exit, a second rider entrance, a second rider exit and a second trough to guide a second rider in a fixed path from said second entrance to said second exit, said first trough comprising a plurality of sets of trough sections, each said set forming one half of a circle and having a respective radius, said plurality of sets comprising an inner set adjacent to said first rider exit, an outer set adjacent to said first rider entrance and one or more intermediate sets between said inner and outer sets, said radius of each respective set that is outward from said inner set being larger than said radius of an adjacent inward set such that said fixed path is a continuous curved path, said second trough comprising a plurality of sets of trough sections, each said set forming one half of a circle and having a respective radius, said plurality of sets comprising an inner set adjacent to said second rider exit, an outer set adjacent to said second rider entrance and one or more intermediate sets between said inner and outer sets, said radius of each respective set that is outward from said inner set being larger than said radius of an adjacent inward set such that said fixed path is a continuous curved path.

14. A waterslide bowl according to claim 13, wherein said first and second troughs are in a nesting, side-by-side arrangement.

15. A waterslide bowl according to claim 13, wherein each said set that is outward from said inner set is larger than said radius of a respectively adjacent inward set by a distance approximately equal to a width of said troughs.

16. A method of making a waterslide bowl having a trough to guide a rider in a fixed path from a rider entrance to a rider exit, comprising:

(a) providing a first set of trough sections, said sections of said first set having a width W, said first set forming one half of a circle having a first radius;

(b) providing a second set of trough sections, said sections of said second set having said width W, said second set forming one half of a circle having a second radius, said second radius being larger than said first radius by a distance equal to or greater than about W/2;

(c) providing said rider entrance and said rider exit; and (d) assembling said first and second sets of trough sections and said rider entrance and rider exit, said first set and said second set comprising said trough.

17. A method according to claim 16, wherein said distance is equal to about W/2.

18. A method according to claim 16, wherein said distance is equal to about W, said bowl has a second trough to guide a second rider in a second fixed path from a second rider entrance to a second rider exit, said method further comprising the steps of:

(e) providing a third set of trough sections, said sections of said third set having said width W, said third set forming one half of a circle having a radius equal to said first radius;

(f) providing a fourth set of trough sections, said sections of said fourth set having said width W, said fourth set forming one half of a circle having a radius equal to said second radius;

(g) providing said second rider entrance and said second rider exit; and (h) assembling said third and fourth sets of trough sections and said second rider entrance and said second rider exit, said third set and said fourth set comprising said second trough.

* * * * *